US008808028B2

(12) United States Patent
Le et al.

(10) Patent No.: US 8,808,028 B2
(45) Date of Patent: Aug. 19, 2014

(54) INTEGRATED AISG CONNECTOR ASSEMBLY

(75) Inventors: Quoc M. Le, Plano, TX (US); Steven L. Schmutzler, Homer Glen, IL (US)

(73) Assignee: Andrew LLC, Hickory, NC (US)

( * ) Notice: Subject to any disclaimer, the term of this patent is extended or adjusted under 35 U.S.C. 154(b) by 67 days.

(21) Appl. No.: 13/428,416

(22) Filed: Mar. 23, 2012

(65) Prior Publication Data

US 2013/0252478 A1 Sep. 26, 2013

(51) Int. Cl.
*H01R 9/05* (2006.01)

(52) U.S. Cl.
USPC ..... 439/579

(58) Field of Classification Search
USPC ..... 439/579, 536, 682; 343/853, 757
See application file for complete search history.

(56) References Cited

U.S. PATENT DOCUMENTS

| | | | | |
|---|---|---|---|---|
| 3,860,930 | A * | 1/1975 | Peterson | 343/705 |
| 4,933,681 | A * | 6/1990 | Estang | 343/765 |
| 6,152,743 | A * | 11/2000 | Fox | 439/63 |
| 6,168,465 | B1 * | 1/2001 | Hirota | 439/579 |
| D459,305 | S * | 6/2002 | Malin | D13/133 |
| 6,573,875 | B2 * | 6/2003 | Zimmerman et al. | 343/853 |
| 6,603,436 | B2 * | 8/2003 | Heinz et al. | 343/757 |
| 6,796,838 | B2 * | 9/2004 | Yoshioka | 439/607.01 |
| 7,048,586 | B2 * | 5/2006 | Ishizaki et al. | 439/607.44 |
| 7,153,160 | B2 * | 12/2006 | Montena | 439/579 |
| 7,357,672 | B2 * | 4/2008 | Montena | 439/584 |
| 7,404,738 | B2 * | 7/2008 | Montena | 439/579 |
| 7,540,775 | B2 * | 6/2009 | Eckel et al. | 439/587 |
| 7,563,103 | B1 * | 7/2009 | Hall et al. | 439/63 |
| 7,753,734 | B2 * | 7/2010 | Eckel et al. | 439/607.41 |
| 7,841,897 | B2 * | 11/2010 | Blake et al. | 439/579 |
| 7,993,144 | B2 * | 8/2011 | Hu et al. | 439/63 |
| 8,052,472 | B2 * | 11/2011 | Uchida | 439/607.28 |
| 8,164,520 | B2 * | 4/2012 | Raeder et al. | 342/359 |
| 2002/0132522 | A1 * | 9/2002 | Miyazaki et al. | 439/559 |
| 2008/0291116 | A1 * | 11/2008 | Le et al. | 343/907 |
| 2011/0003507 | A1 * | 1/2011 | Van Swearingen et al. | 439/578 |
| 2011/0267231 | A1 * | 11/2011 | Le et al. | 342/359 |

OTHER PUBLICATIONS

"*Steckverbinder für 3G/4G-Mobilfunknetzwerke—Connectors for 3G/34G Mobile Radio Networks; Components for the mobile networks infrastructure*," pp. 1-6, available at: http://www.lumberg.com/main/eng/lco/3g4g_1_eng.asp, Brochure (PDF) 2,7 mb, Brochure_3G-4G-Mobile_Radio_Networks%201103[1].pdf—Adobe Acrobat Pro, 2011.

* cited by examiner

*Primary Examiner* — Alexander Gilman
(74) *Attorney, Agent, or Firm* — Husch Blackwell LLP

(57) ABSTRACT

A connector assembly is provided. In one example, the connector assembly includes a connector plate, a connector bracket, and a wiring set. The connector plate has a male connector shell and a female connector shell. The connector bracket has a male connector core and a female connector core. The connector bracket is dimensioned to be mounted on the connector plate with the male connector core disposed within the male connector shell and the female connector core disposed within the female connector shell. The wiring set is coupled to the male connector core and to the female connector core, and is further provides a pigtail connection.

9 Claims, 4 Drawing Sheets

INTEGRATED AISG CONNECTOR ASSEMBLY

FIELD OF THE INVENTION

The present invention generally relates to actuators for use in wireless communications equipment. In particular, the invention relates to an improved connector assembly for use in such actuators.

BACKGROUND OF THE INVENTION

Wireless mobile communication networks continue to evolve given the increased traffic demands on the networks, the expanded coverage areas for service and the new systems being deployed. Cellular ("wireless") communications networks rely on a network of base station antennas for connecting cellular devices, such as cellular telephones, to the wireless network. Many base station antennas include a plurality of radiating elements in a linear array. Various attributes of the antenna array, such as beam elevation angle, beam azimuth angle, and half power beam width may be adjusted by electrical-mechanical controllers. See, for example, U.S. Pat. Nos. 6,573,875 and 6,603,436, both of which are incorporated by reference. For example, with respect to U.S. Pat. No. 6,573,875, a plurality of radiating elements may be provided in an approximately vertical alignment. A feed network may be provided to supply each of the radiating elements with a signal.

The phase angle of the signals provided to the radiating elements may be adjusted to cause a radiated beam angle produced by the antenna array to tilt up or down from a nominal or default beam angle. The phase angles may be adjusted by operating electromechanical components, such as phase shifter. Phase shifters may be employed to adjust beam downtilt and/or beam azimuth angle, and/or to adjust power division, and thereby adjust beam width. In one example, phase shifters may be coupled to an actuator, allowing remote control of the adjustment of the phase shifter.

One set of industry standards for remote control of a phase shifter actuator is promulgated by the Antenna Interface Standards Group (AISG). Attributes of an antenna array may be controlled by communicating instructions from a controller to an actuator over an AISG-compliant communications link.

Among other things, this group has set forth standards for connectors which may be used base station equipment. Connectors which adhere to these standards are often referred to as "AISG-compliant connectors," or simply, "AISG connectors." However, known AISG connectors have certain disadvantages. For example, known AISG connectors are individually installed on a cellular communications actuator, typically by using a threaded nut. If the mounting hardware loosens in the field, the connector may rotate when cables are being attached or removed, causing damage to internal wiring. Also, installing wiring harnesses to the connectors after installation on an actuator subjects the remainder of the actuator to the risk of damage from handling and/or electrostatic shock.

SUMMARY

A connector assembly is provided. In one example, the connector assembly includes a connector plate, a connector bracket, and a wiring set. The connector plate has a male connector shell and a female connector shell. The connector bracket has a male connector core and a female connector core. The connector bracket is dimensioned to be mounted on the connector plate with the male connector core disposed within the male connector shell and the female connector core disposed within the female connector shell. The wiring set is coupled to the male connector core and to the female connector core, and is further provides a pigtail connection. The pig tail connection may be used for connecting the wiring set to a circuit board.

In one example, the connector plate is cast metal and the connector bracket is moulded plastic. In another example, the connector assembly complies with AISG standards. The connector plate may be integrally formed with a base for an AISG-compliant actuator.

A connector assembly according to the present invention may be advantageously used as part of a cellular communications actuator. In this example, the invention includes a cellular communications actuator having a base, the base having a connector plate, the connector plate further having a male connector shell and a female connector shell. A circuit board and a motor may be mounted on the base, where the motor is coupled to the circuit board. A drive gear, adapted to be coupled to an electromechanical feed network may be included. The actuator may also include a connector bracket having a male connector core and a female connector core, the connector bracket being dimensioned to be mounted on the connector plate with the male connector core disposed within the male connector shell and the female connector core disposed within the female connector shell. Additionally, a wiring set, coupling the male connector core to the female connector core and further providing a pigtail connection to the circuit board may be included.

The connector plate, male connector shell and female connector shell may be cast as a single unit. In one example, the male connector shell and the female connector shell have threads dimensioned to engage with threaded connectors for control cables. For example, the male connector core, the male connector shell, the female connector core and the female connector shell may be dimensioned to comply with AISG standards.

DETAILED DESCRIPTION

Figure 1:
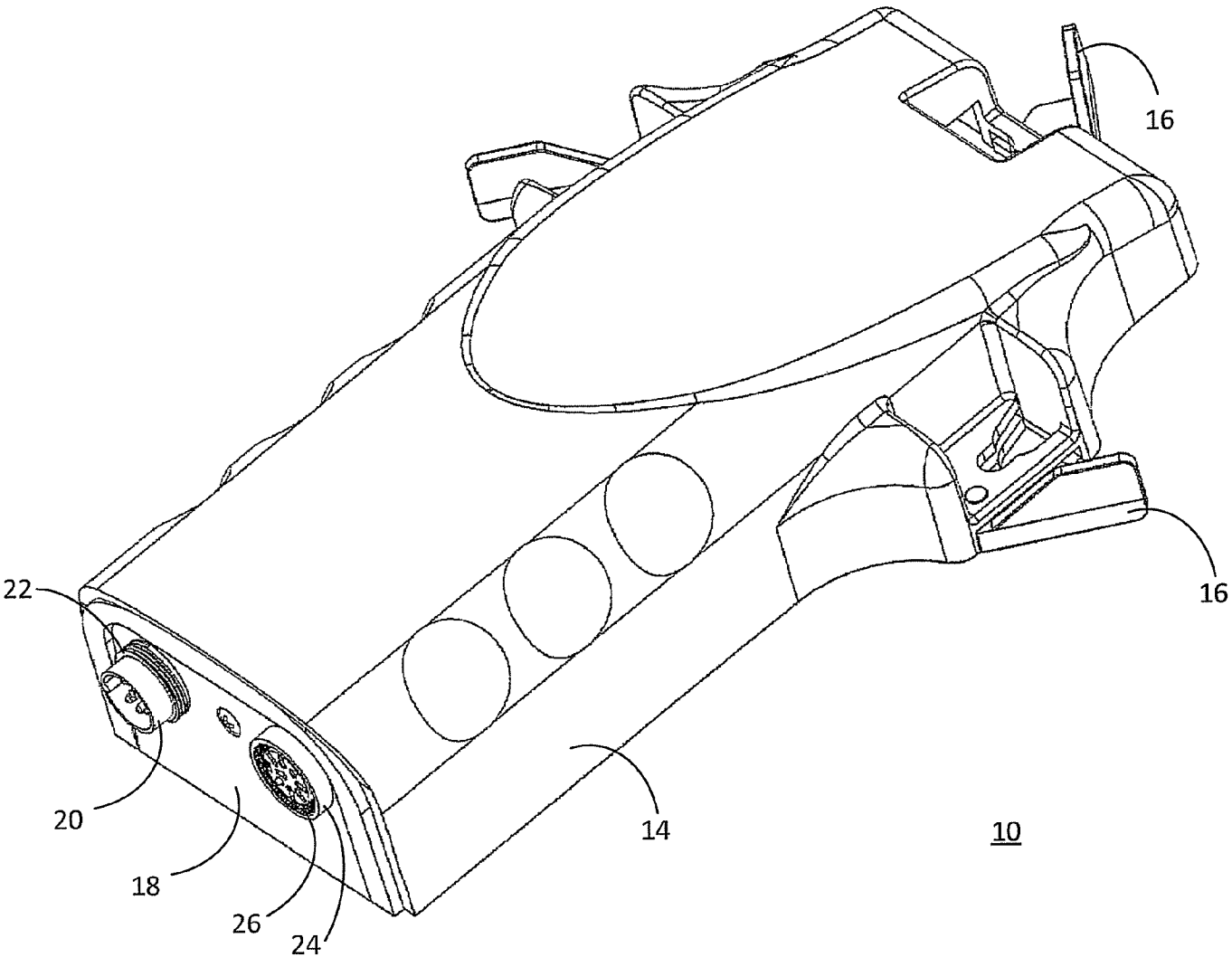
FIG. 1 is a perspective view of an actuator according to an example of the present invention.
Figure 2:
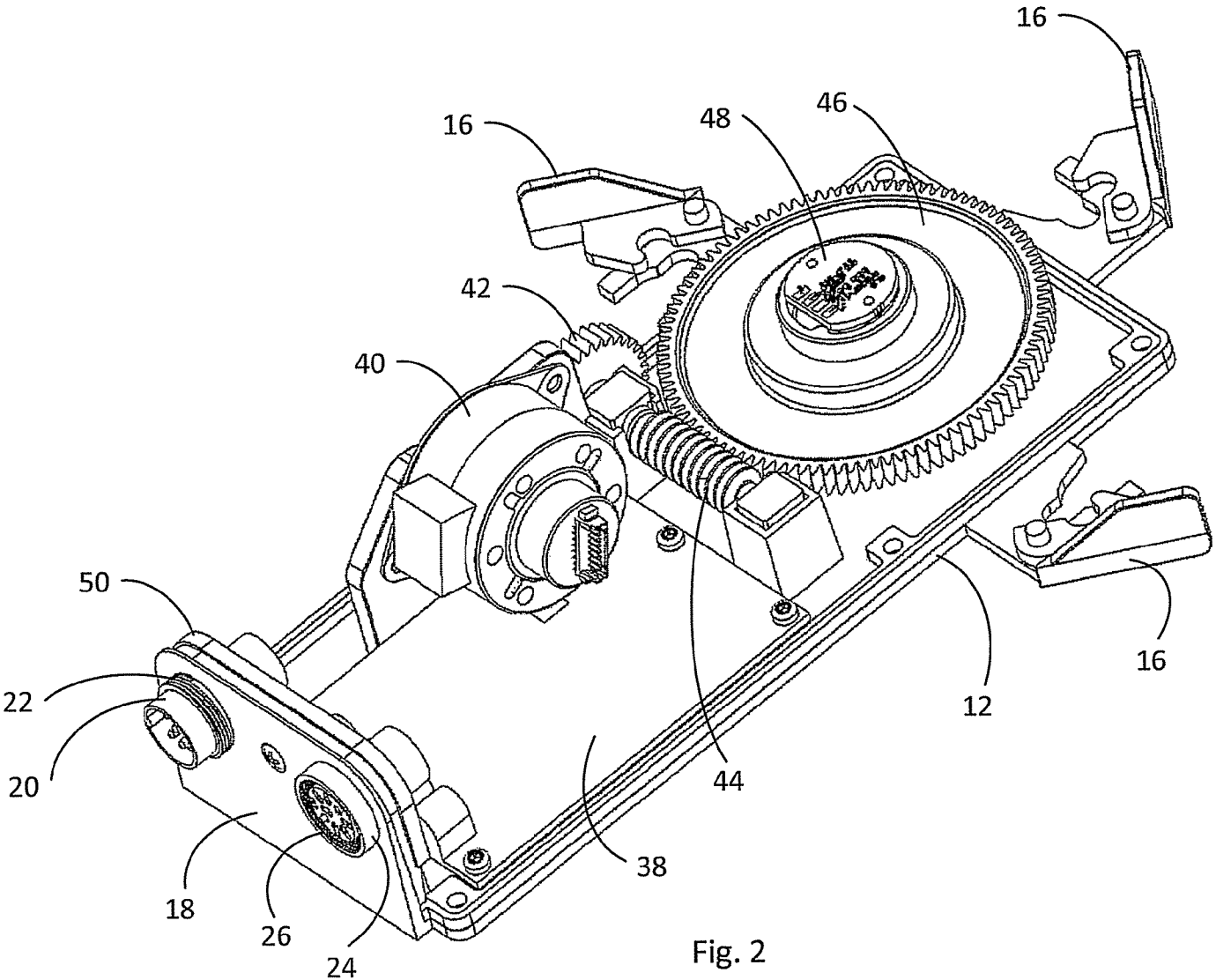
FIG. 2 is a perspective view of an actuator according to an example of the present invention with the cover removed.

Referring to FIGS. 1 and 2, an actuator 10 includes a base 12, a cover 14, and latches 16. The base 12 may further include a connector plate 18. FIG. 2 illustrates the actuator 10 with the cover 14 removed to allow viewing of internal components in relation to base 12.

Connector plate 18 includes male AISG shell 20 and female AISG shell 24. male AISG shell 20 includes outer threads 22 and female AISG shell 24 includes inner threads 26. Base 12, connector plate 18, male AISG shell 20 and female AISG shell 24 may be cast as a single unit. In one example, base 12 and connector plate 18 are cast metal, such as aluminum. Outer threads 22 and inner threads 26 may be added by a machining operation after base 12 and connector plate 18 are cast. The threads may be dimensioned for receiving threaded connectors for control cables, such as AISG-compliant cables (not shown).

Cover 14 may provide an environmental seal to protect electronics inside the actuator 10. Latches 16 allow the actuator 10 to be installed on a structure, such as an antenna panel (not illustrated) without tools. The antenna panel would have corresponding structure to engage the latches 16. Cover 14 may be removably attached to base 12.

Actuator 10 may further include circuit board 38, motor 40, spur gear 42, worm gear 44, and drive gear 46 mounted on base 12. Circuit board 38 may include electronic components for communicating with remote AISG controllers, for activating motor 40, and for performing diagnostic, reporting and test functions. In one example, drive gear position sensor 48 may be included. In this example, circuit board 38 is coupled to position sensor 48, and may drive motor 40 until a desired physical angle of drive gear 46 is achieved. The desired physical angle may be determined by reference to a look-up table, which contains a correspondence between beam downtilt angles (and for other antenna attributes) and physical angles. The motor 40 drives spur gear 42, which causes worm gear 44 to rotate, thereby actuating drive gear 46. When installed on an antenna, drive gear 46 may be directly coupled to a phase shifter by a drive shaft. Alternatively, drive gear 46 may be connected to a linkage which is coupled to one or more phase shifters.

In the illustrated example, drive gear 46 may provide a rotary actuation on its drive shaft. In an alternative embodiment, the drive gear may provide a linear actuation, e.g., a worm gear or rack and pinion driving a push rod.

Figure 3:
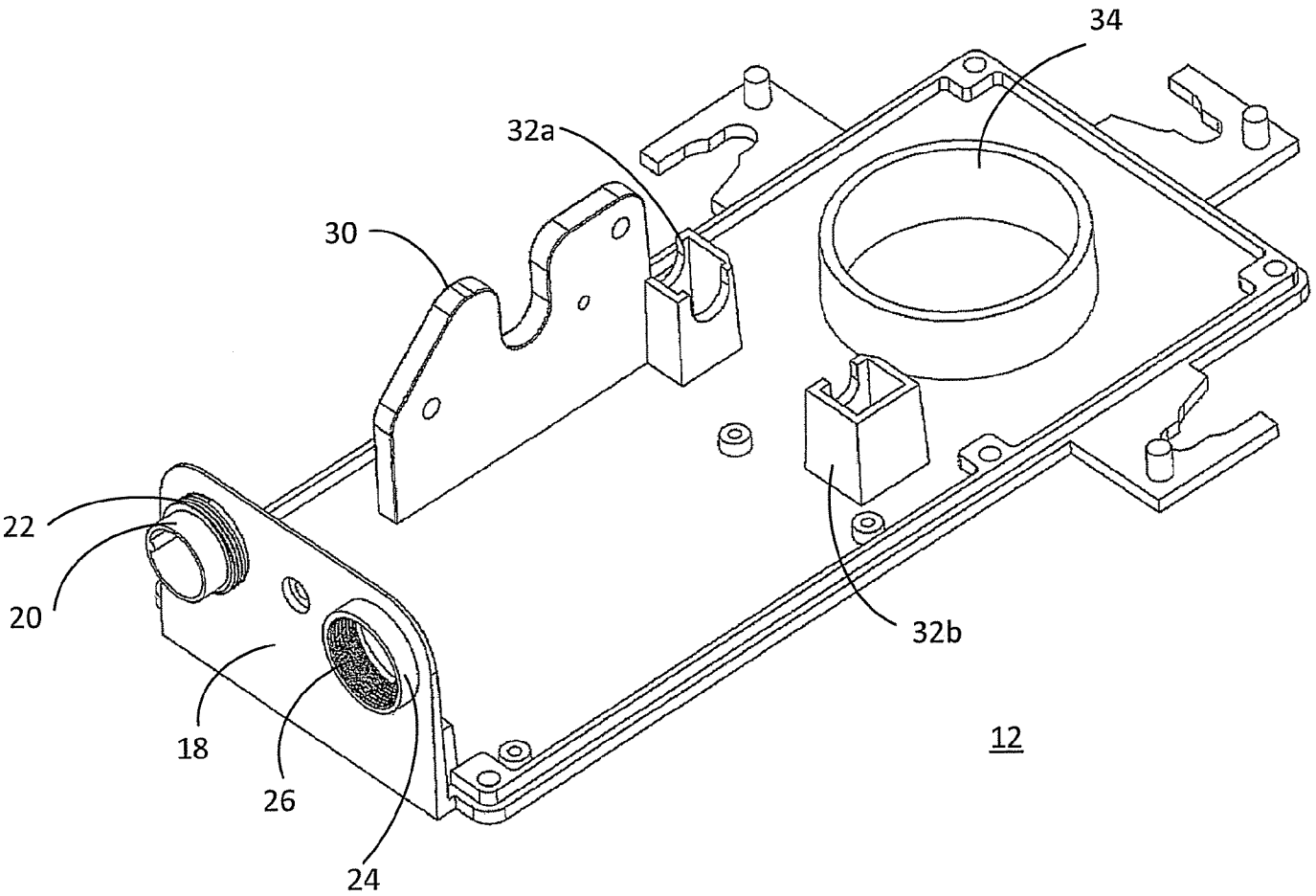
FIG. 3 is a perspective view of a base that may be used in connection with examples of the present invention.

Referring to FIG. 3, an example of a base 12 is illustrated. Base 12 may include some or all of the following additional structure: motor bracket 30, worm gear supports 32*a*, 32*b*, drive gear and support 34. As with the other features of base 12, the features may be formed by casting and/or machining.

Figure 4:
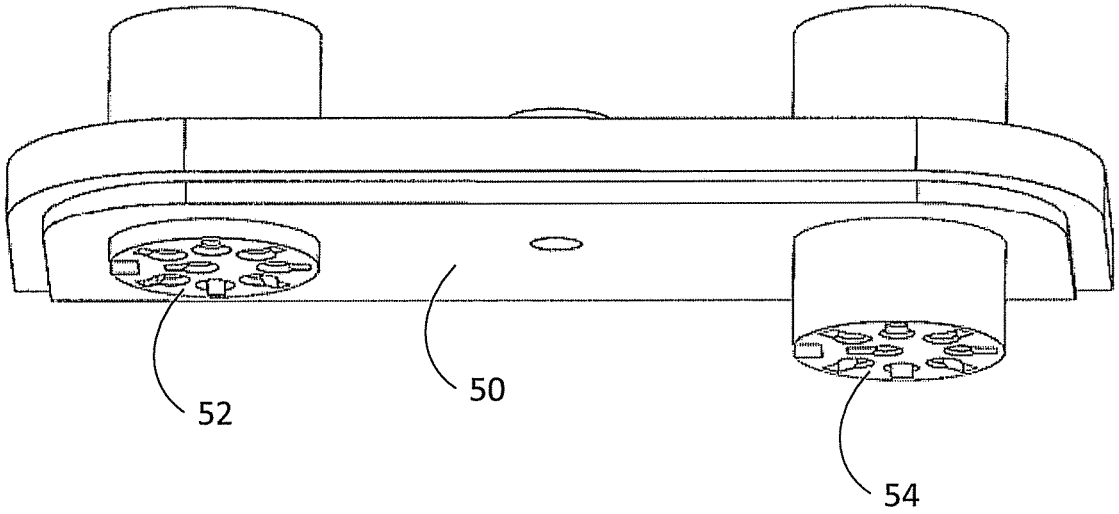
FIG. 4 is a perspective view of a bracket according to an example of the present invention.
Figure 5:
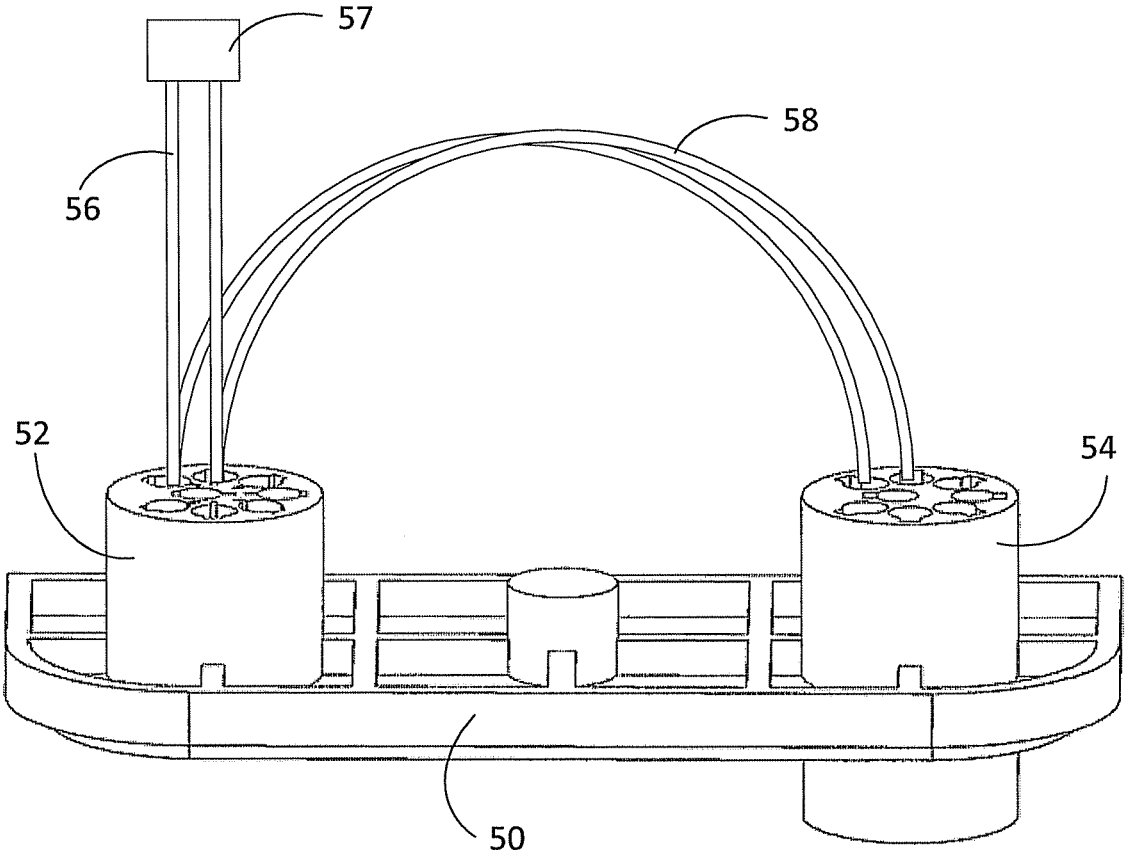
FIG. 5 is another perspective view of a bracket according to an example of the present invention.

Referring to FIGS. 4 and 5, AISG bracket 50 is illustrated. AISG bracket 50 includes a male connector core 52 and a female connector core 54. AISG bracket 50, including the male connector core 52 and the female connector core 54, are dimensioned such that AISG bracket 50 may be installed on an inside surface of connector plate 18, with male connector core 52 located inside male AISG shell 20, and female connector core 54 located inside female AISG shell 24.

Referring to FIG. 5, pigtail conductors 56 and daisy chain conductors 58 are illustrated. Only two conductors are illustrated for clarity, however, it is contemplated that the connector cores 52, 54 may be more fully populated. Pigtail 56 and a first end of daisy chain 58 share common connector pins (not shown) inserted in male connector core 52. A second end of daisy chain 58 has individual conductors going to single connector socket pins. Pigtail 56 includes a connector 57 that may attach to circuit board 38.

AISG bracket 50 may be pre-assembled with a wiring set daisy chain 58 and pigtail 56 prior to installation of the AISG bracket 50 on connector plate 18. This reduces assembly costs and improves reliability compared to known individual AISG connectors because the connector cores 52, 54, pigtail 56 and daisy chain 58 may be assembled and tested without subjecting the remaining components of the actuator 10 to mechanical damage or electrostatic shock damage. During assembly, AISG bracket 50 is fitted onto the inside surface of connector plate 18, and attached with a screw. Two daisy-chained AISG connectors are formed simultaneously when the pre-wired AISG bracket 50 is fitted onto the connector plate 18. There is no need to fit individual connectors to the actuator 10.

Additional advantages of the invention include a more reliable connector assembly. For example, outer threads 22 and inner threads 26 are machined onto male AISG shell 20 and female AISG shell 24, respectively, which may be cast along with connector plate 18. Accordingly, there is no chance that the connector shells will come loose or rotate when AISG cables are threaded onto or removed from the connectors. Also, forming male connector core 52 and female connector core 54 as part of AISG bracket 50 further prevents any rotation of the connector cores as cables are attached or removed. Because the AISG shells 20, 24 and AISG cores 52, 54 cannot rotate with respect to the connector plate 18 or the base 12, pigtail conductors 56 and daisy-chain conductors 58 will not be twisted or otherwise damaged during AISG cable attachment or removal. This is significant improvement over known individual AISG connectors because AISG cables are often attached and removed after the antenna is mounted on a cellular communications tower.

What is claimed is:

1. A connector assembly, comprising:

a. a connector plate having a male connector shell and a female connector shell integrally formed with the connector plate;

b. a connector bracket having a male connector core and a female connector core integrally formed with the connector bracket, the connector bracket being dimensioned to be mounted on the connector plate with the male connector core disposed within the male connector shell and the female connector core disposed within the female connector shell; and c. a wiring set, coupling the male connector core to the female connector core and further providing a pigtail connection.

2. The connector assembly of claim 1, wherein the connector plate, the male connector shell and the female connector shell are cast as a single unit.

3. The connector assembly of claim 2, wherein the male connector shell and the female connector shell have threads dimensioned to engage with threaded connectors for control cables.

4. The connector assembly of claim 1, wherein the connector assembly complies with AISG standards.

5. The connector assembly of claim 1, wherein the connector bracket, the male connector core and the female connector core are molded as a single unit.

6. A cellular communications actuator, comprising:

a. a base, having a connector plate, the connector plate further having a male connector shell and a female connector shell;

b. a circuit board mounted on the base;

c. a motor mounted on the base and coupled to the circuit board;

d. a drive gear, adapted to be coupled to an electromechanical feed network;

e. a connector bracket integrally molded with a male connector core and a female connector core, the connector bracket being dimensioned to be mounted on the connector plate with the male connector core disposed within the male connector shell and the female connector core disposed within the female connector shell; and f. a wiring set, coupling the male connector core to the female connector core and further providing a pigtail connection to the circuit board.

7. The cellular communications actuator of claim 6, wherein the connector plate, male connector shell and female connector shell are cast as a single unit.

8. The cellular communications actuator of claim 7, wherein the male connector shell and the female connector shell have threads dimensioned to engage with threaded connectors for control cables.

9. The cellular communications actuator of claim 6, wherein the male connector core, the male connector shell, the female connector core and the female connector shell comply with AISG standards.

* * * * *